US005954593A

United States Patent [19]

Benoit et al.

[11] Patent Number: 5,954,593

[45] Date of Patent: Sep. 21, 1999

[54] GOLF PUTTING DEVICE

[75] Inventors: Robert L. Benoit, Oakdale; William F. Fahey, Kings Park; Bernard I. Rachowitz; Glenn L. Spacht, both of Lloyd Neck, all of N.Y.

[73] Assignee: NBG Technologies, Inc., Hauppauge, N.Y.

[21] Appl. No.: 09/017,755

[22] Filed: Feb. 3, 1998

Related U.S. Application Data

[62] Division of application No. 08/831,587, Apr. 9, 1997, Pat. No. 5,776,016.

[51] Int. Cl.[6] ..... A63B 69/36

[52] U.S. Cl. ..... 473/240; 473/251

[58] Field of Search ..... 473/240, 242, 473/250, 251, 219, 223, 220, 313, 340; D21/736, 737

[56] References Cited

U.S. PATENT DOCUMENTS

| | | | |
|---|---|---|---|
| 2,463,798 | 3/1949 | Paisley . | |
| 3,019,022 | 1/1962 | Ehmke . | |
| 3,403,912 | 10/1968 | Maroun . | |
| 3,810,633 | 5/1974 | Scott | 473/240 |
| 4,367,877 | 1/1983 | Gibson | 473/240 |
| 4,844,468 | 7/1989 | Lee . | |
| 4,953,866 | 9/1990 | Bang . | |
| 5,195,749 | 3/1993 | Ugarte | 473/240 |

*Primary Examiner*—Sebastiano Passaniti
*Attorney, Agent, or Firm*—Salzman & Levy

[57] ABSTRACT

An improved optical putter. The optical putter has a club head whose cross-section is characterized as having four active surfaces: a substantially flat surface for resting the club head upon the green in a first alignment position; a ball-addressing surface; a second, substantially flat, reflective surface for aligning the golf club in a second alignment position; and a substantially flat bottom surface that is substantially perpendicular to the ball-addressing surface. The reflective surface is a semi-circular wedge shape having a sighting line for guiding the golfer to position her or her head and stance. Depending upon the alignment position, the reflecting surface can face upwardly towards the eye of the golfer or towards the cup of the green.

15 Claims, 3 Drawing Sheets

GOLF PUTTING DEVICE

This application is a divisional of application Ser. No. 08/831,587, filed Apr. 9, 1997, now U.S. Pat. No. 5,776,016.

FIELD OF THE INVENTION

The present invention relates to golf putters and, more particularly, to a golf putter and method for optical sighting and aligning the club head face with the cup of the green, and for positioning the golfer's head over the club head as the golf ball is addressed.

BACKGROUND OF THE INVENTION

Golf is a very popular sport, but many aficionados and dilettantes of this pastime find the recreation frustrating and difficult to master. One of the problems presenting itself to the average golfer is the difficulty at mastering the putting game. Many a golfer has approached the green with a possible par score in sight, only to fail by three-putting on the green.

A proper putting technique is difficult to attain, and is elusive even to some professionals of the sport.

The present invention seeks to provide a new type of putter and method that will assist the hacker and professional alike. The method of this invention first properly positions the head of the golfer over the golf club head. This is accomplished by laying the back of the club head on the green, which positions the shaft of the golf club at an approximate forty-five degree angle with respect to both the vertical and horizontal axes. In this position, a reflective surface comprising a sight mark disposed on the club head adjacent the club head face is horizontally parallel to the green. The sight mark allows the golfer to position his or her head directly over the club.

Thereafter, the golf club is gripped by the golfer in a ball-addressing position. That is, the shaft of the golf club is gripped in a substantially vertical position by the golfer. The reflective surface on the club head is now positioned at an approximate forty-five degree angle with respect to both the horizontal and vertical axes.

The reflective surface will now project an image of the cup to the eye of the golfer, whose head has been previously adjusted directly over the club face. The golfer now adjusts the club face to address the ball towards the cup. The new putter of this invention and the aforementioned optical sight method provide the needed adjustments to align and address the ball with accuracy and precision.

DISCUSSION OF THE RELATED ART

A number of United States patents teach the use of putters featuring mirrored and reflective surfaces for sighting the cup of the green. Some also teach positioning the head of the golfer over the club head and the ball. Such principles are illustrated in U.S. Pat. No. 3,403,912, issued to Maroun on Oct. 1, 1968; U.S. Pat. No. 2,463,798, issued to Paisley on Mar. 8, 1949; U.S. Pat. No. 3,019,022, issued to Ehmke on Jan. 30, 1962; U.S. Pat. No. 4,953,866, issued to Bang on Sep. 4, 1990; and U.S. Pat. No. 4,844,468, issued to Lee on Jul. 4, 1989.

The present invention uses a putter having a mirrored surface, a highly polished metal surface, or a highly reflective plated metal surface as its sighting surface. A chromium plated surface can achieve the required reflection as will a highly polished brass surface. The invention, however, goes much further than reflecting the lie upon the green. The current invention actually uses a novel putter design that features a new method of aligning and addressing the ball. The club is designed so that the golfer first rests the club head on its side in order to align the shot. Thereafter, the golfer repositions the club vertically in order to address the ball. The sight of the cup can be viewed through the reflective surface without taking one's eyes off the reflective club face, or moving one's head from over the club head and ball.

SUMMARY OF THE INVENTION

In accordance with the present invention, there is provided an optical putter for more accurately aligning a ball with the cup of the green. The putter comprises a club head having a reflective surface disposed on a top portion of its club head body. The reflective surface is angled at approximately forty-five degrees with respect to both the horizontal and vertical axes. A sighting mark is disposed in the middle of the reflective surface. The back of the club head comprises a flat surface that allows the club head to rest on the green. In this position, the reflective surface becomes substantially parallel to the green, or, in other words, horizontal. In this position, the shaft of the golf club extends at an approximate forty-five degree angle with respect to both the horizontal and vertical axes. The golfer positions his or her head directly over the sighting mark, by looking straight downwardly at the sighting mark. Once having attained this position, the golf shaft is gripped, substantially vertically aligned, and the club head is positioned to address the golf ball. In this position, the reflective surface is now disposed at approximately forty-five degrees with respect to both the horizontal and vertical axes. The reflective surface will now project an image of the ball and the cup to the eye of the golfer. The golfer now adjusts the club head face to address the ball squarely at the hole. The reflective surface is shaped as a semi-circular wedge, allowing a wide field of view in which to sight and align the putter with the ball and the cup. The golfer now draws the club straight back, and then strokes the ball towards the cup.

The club head of the optical putter in cross-section is characterized as comprising four active surfaces: a substantially flat surface for resting the club head upon the green in a first alignment position; a ball-addressing surface; a second, substantially flat, reflective surface for aligning the golf club in a second alignment position; and a substantially flat bottom surface that is substantially perpendicular to the ball-addressing surface.

It is an object of the invention to provide an improved optical putter and method that assists the golfer in aligning the putter with the cup of the green.

It is another object of this invention to provide an optical putter and method that provides means by which the head of the golfer can be positioned directly over the club head and ball before he or she aligns the club with the cup.

It is but another object of the invention to aid the golfer in achieving a putting stroke that is coincident with the desired path of the ball, by observing the reflection of the ball in the reflective surface of the club, as the club is drawn back and then stroked towards the ball.

It is a further object of the invention to provide a putter having a reflective surface that projects an image of the cup and green to the eye of the golfer over a wide angle of view.

BRIEF DESCRIPTION OF THE DRAWINGS

A complete understanding of the present invention may be obtained by reference to the accompanying drawings, when considered in conjunction with the subsequent detailed description, in which.

For the purposes of clarity and brevity, all like components and elements will bear the same designation and numbering throughout the FIGURES.

DESCRIPTION OF THE PREFERRED EMBODIMENT

Generally speaking, the invention features an optical sighting putter. The sighting putter provides means by which the head of the golfer is positioned directly over the club head and ball before he or she aligns the club with the cup. A shaft of the golf club is disposed at approximately a forty-five degree angle with respect to both the horizontal and vertical axes, when the back of the club head is rested upon the green. In this position, a reflective surface on the club head is approximately horizontally parallel with the green. The golfer's head can be positioned over the reflective surface using a sighting mark disposed thereon. The shaft of the golf club is then gripped by the golfer in a ball-addressing position. The reflective surface is now positioned at approximately a forty-five degree angle with respect to both the horizontal and vertical axes. The reflective surface will now project an image of the cup, ball and the green back to the eye of the golfer. The golfer now adjusts the club face to align it to squarely strike the golf ball towards the cup. The golfer observes the reflection of the ball in the reflective surface, as he or she draws the club head back prior to striking the ball. The stroke is adjusted to align the ball with the sighting mark, thus assuring an accurate stroke as the putter is brought forward to strike the ball.

Figure 1:
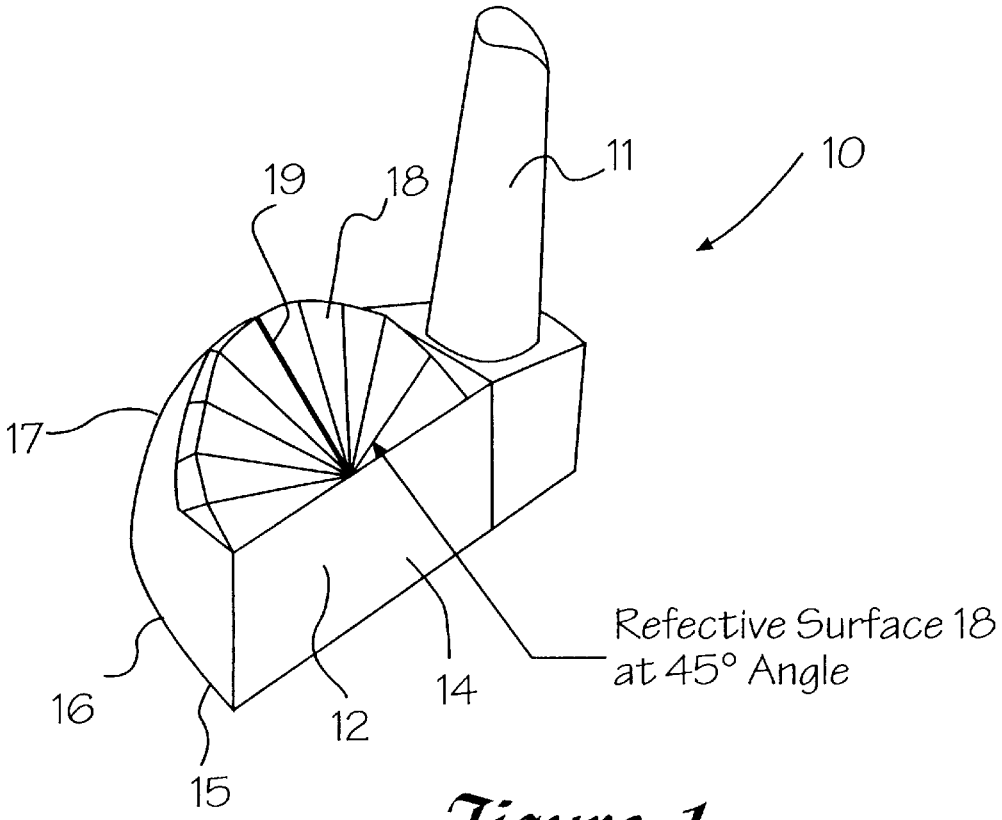
FIG. 1 illustrates a perspective view of the optical putting device of this invention.

Now referring to FIG. 1, there is shown a perspective view of the optical sighting putter 10 of this invention. The optical putter 10 comprises a shaft 11 (shown cut-away), and a club head 12. The club head 12 comprises four active surfaces: a substantially vertical, flat surface 14 used to address the ball; a substantially flat surface 15 that is substantially perpendicular to the addressing surface 14; a substantially flat surface 16 adjacent to surface 15, that is used to position the head of the golfer in a first alignment position (illustrated in FIG. 2); and a reflective surface 18. The generally curvilinear back surface 17 disposed between surfaces 16 and 18 has no functional purpose.

Figure 3:
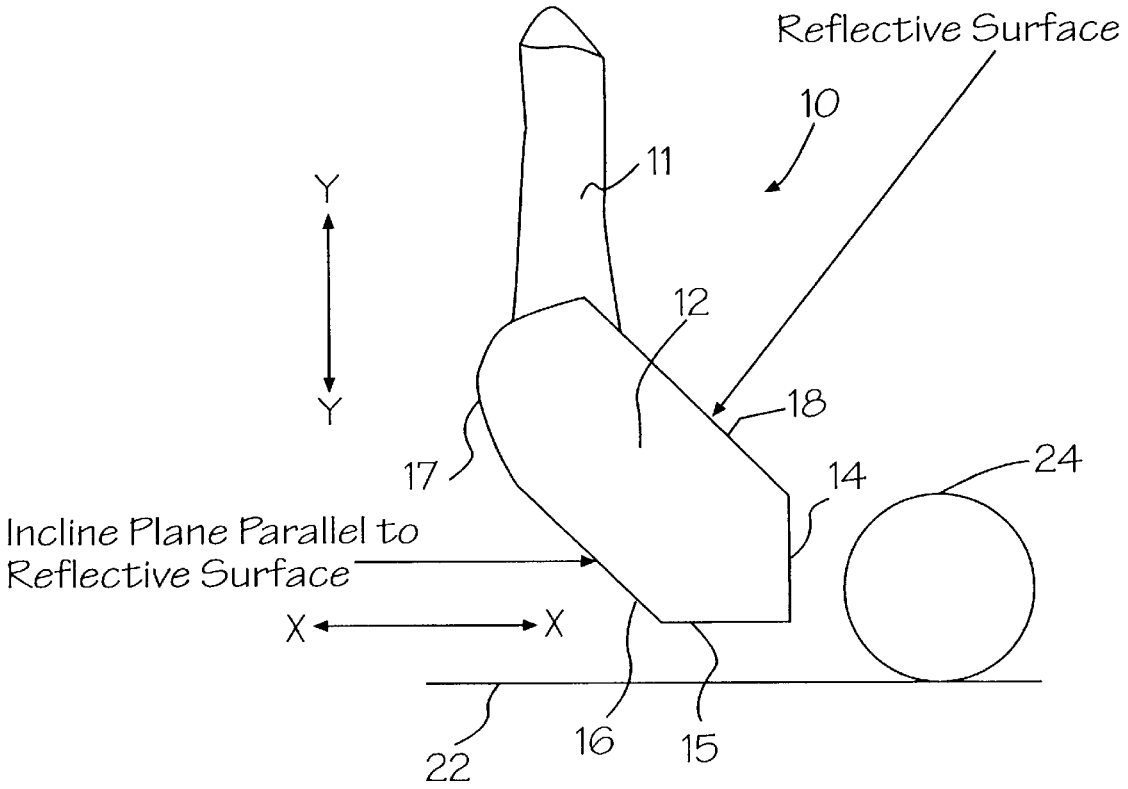
FIG. 3 shows a side view of the optical putting device shown in FIG. 1, with the putter illustrated in its ball-addressing position.

The reflective surface 18 is shaped substantially as a semi-circular wedge. In the ball-addressing position (putting position) illustrated in FIGS. 1 and 3, the reflective surface 18 is disposed at approximately forty-five degrees to the horizontal X—X axis, and to the vertical Y—Y axis, as shown in FIG. 3. The reflective surface 18 may be formed in several ways, to wit: (a) it can be a highly polished brass or other metal surface; (b) it can be a highly reflective plated surface, such as a chromium or silver plated surface; or (c) it can comprise a thin strip of a mirror that is adhesively attached to the club head 12.

The reflective surface comprises a sighting line 19, as illustrated in FIG. 1. The purpose of the sighting line 19 will be explained hereinafter with reference to FIGS. 2 and 3, respectively.

Figure 2:
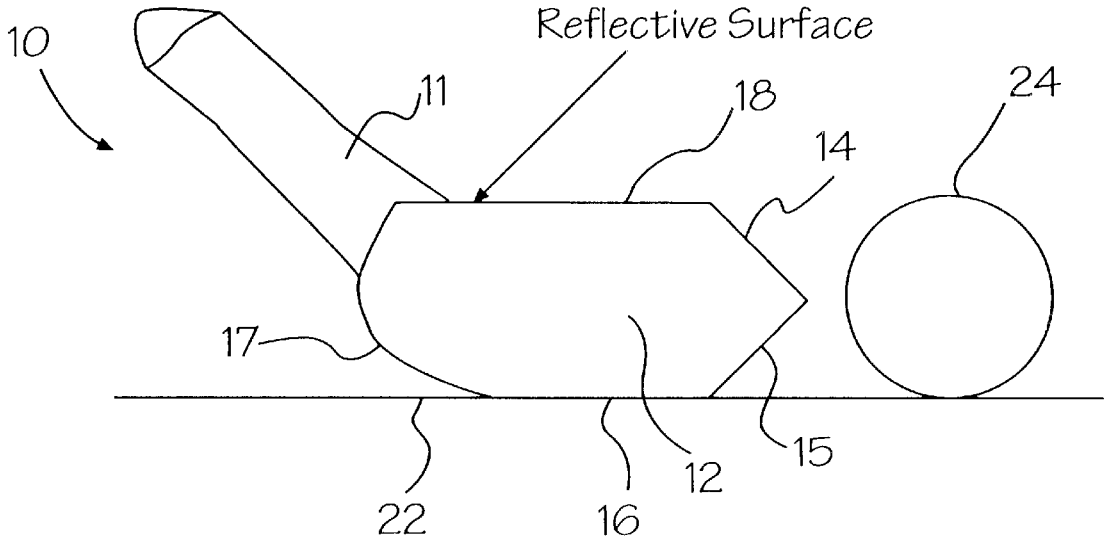
FIG. 2 depicts a side view of the optical putting device shown in FIG. 1, with the putter illustrated in its head alignment position.
Figure 4:
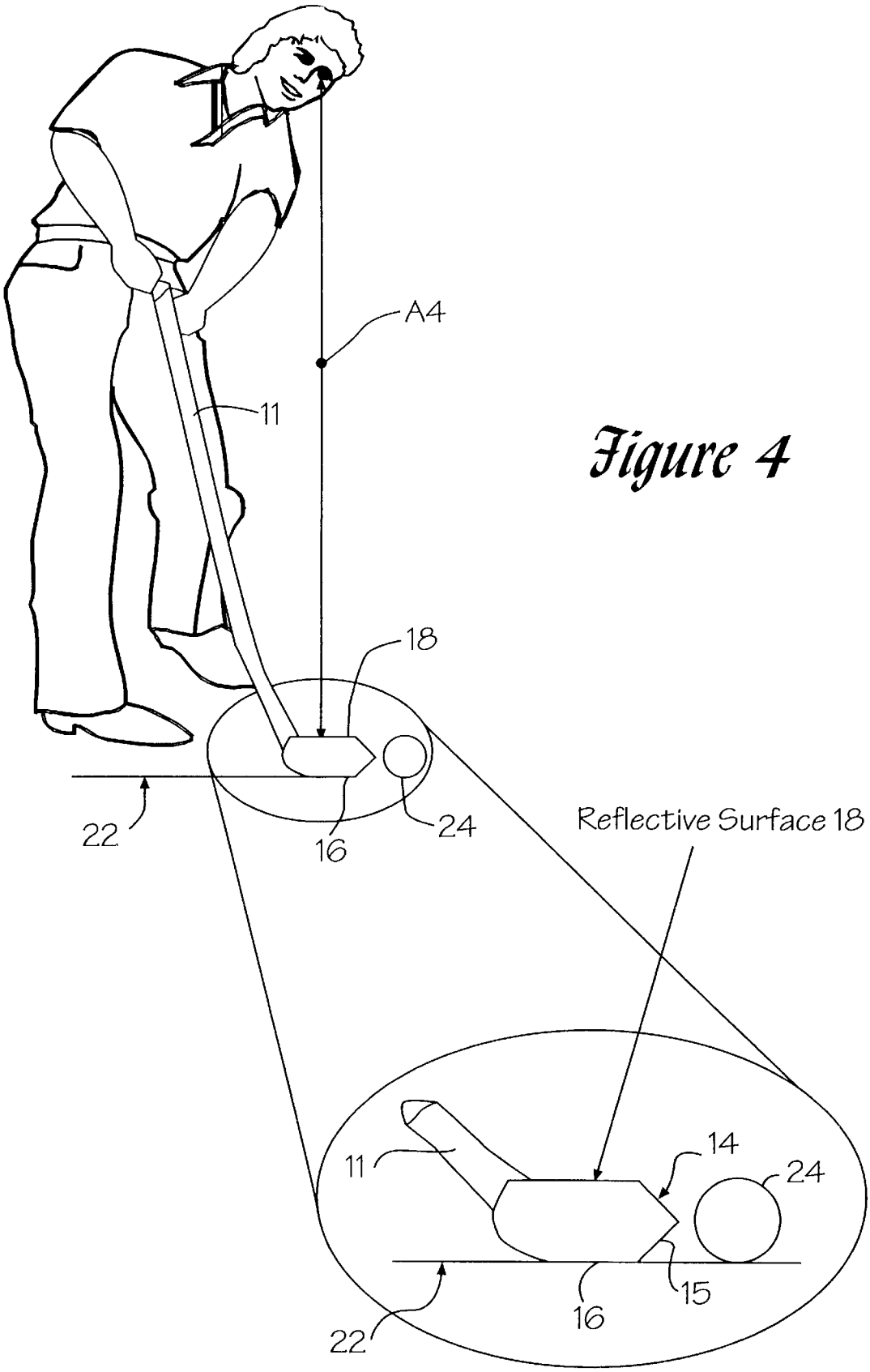
FIG. 4 depicts an in situ, frontal view of a golfer aligning his head over the club head of the golf club of this invention, when the club head is in a non-putting position in accordance with FIG. 2.

Referring to FIGS. 2 and 4, the club head 12 is shown with its flat surface 16 resting upon the green 22, and the club head 22 adjacent a golf ball 24 that is to be addressed and putted to the cup (not shown) of the green 22. In this position, it will be observed that the reflective surface 18 is substantially parallel to the green 22 and to surface 16. It will also be observed that the shaft 11 is angled at approximately forty-five degrees with both the vertical and horizontal axes.

FIGS. 2 and 4 represent a first alignment position for the golf club 10. The first alignment position allows the golfer to position his or her head directly over the club head 12 and ball 24. The sight line 19 on the reflective surface 18 faces upwardly towards the eye of the golfer. The sight line 19 is used as a guide for the golfer to position his or her head. The eye of the golfer is directed downwardly towards the sight line 19, and the golfer adjusts his or her stance to provide the proper propinquity and adjacency with respect to the club head 12.

Having aligned the stance and eye with the club head 12, the golfer is now ready to align the club head 12 with the cup of the green 22, as is illustrated in FIG. 3, in which the club head 12 is depicted in the second alignment position. In this position, it will be observed, the addressing surface 14 is directly adjacent ball 24 with flat surface 15 substantially parallel to the green 22. It will also be observed that the shaft 11 is now in a vertical position to be gripped by the golfer with the reflective surface 18 disposed at an approximate angle of forty-five degrees both to horizontal (X—X) and to vertical (Y—Y) axes. As the golfer peers downwardly at the reflective surface 18, his or her vision will gaze upon the reflection of the cup that is now disposed upon the reflective surface 18. The golfer will use the sighting line 19 to rotate the shaft 11 to play the lie of the green 22. Surface 15 can be rested upon the green 22 as the club head 12 is rotated into alignment position.

Having aligned the position of the club head 12 with the cup, the golfer is now ready and able to address the golf ball 24, and send it towards the cup. The golfer will now draw the club head 12 straight back without twisting the shaft 11, and then stroke the golf ball 24 towards the cup.

The golfer will observe the reflection of the golf ball 24 on the reflective surface 18, as he or she draws the club head 12 back. The golfer guides the stroke to superimpose the reflection of the golf ball 24 on the sight line 19, thus ensuring that the back-stroke will remain straight.

The golf club 10 can be made from known golfing materials as befits the teaching of this art.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A golf putter, comprising:

a shaft for gripping said golf putter; and a club head attached to said shaft, said club head being characterized by four active surfaces including a substantially flat surface for resting said club head upon a green in a first alignment position; a ball-addressing surface; a second, substantially flat, reflective surface for aligning said golf putter in a second alignment position with a cup of the green said reflective surface being oriented substantially parallel to said flat surface; and a substantially flat bottom surface that is substantially adjacent to said ball addressing surface.

2. The golf putter in accordance with claim 1, wherein said substantially flat bottom surface is substantially perpendicular to said ball-addressing surface.

3. The golf putter in accordance with claim 1, wherein said reflective surface is sized to provide a substantially semi-circular, view of a cup and a green.

4. A golf putter, comprising:

a shaft for gripping said golf putter; and a club head attached to said shaft, said club head having means defining a reflective surface on an upper portion thereof and a substantially flat surface on a portion of said head opposite said reflective surface, said reflective surface being substantially parallel to a green surface when said substantially flat surface of said club head is resting upon said green in a first alignment position, and being substantially angled at an angle of approximately forty-five degrees with respect to both horizontal and vertical axes when said club head is in a second alignment position congruent to addressing a golf ball to be putted towards a cup of the green.

5. The golf putter in accordance with claim 4, wherein said means defining said reflective surface comprises a substantially semi-circular wedge disposed on the upper portion of said club head.

6. The golf putter in accordance with claim 4, wherein said means defining said reflective surface comprises a polished surface on the upper portion of said club head.

7. The golf putter in accordance with claim 4, wherein said means defining said reflective surface comprises a plated surface on the upper portion of said club head.

8. The golf putter in accordance with claim 4, wherein said means defining said reflective surface comprises a mirrored surface on the upper portion of said club head.

9. The golf putter in accordance with claim 4, further including a sight line disposed upon said reflective surface.

10. A golf putter, comprising:

a shaft for gripping said golf putter; and a club head attached to said shaft, said club head having means defining a reflective surface on an upper portion thereof and a substantially flat surface on a portion of said head opposite said reflective surface, said reflective surface further comprising means both for aligning a stance of a golfer with respect to said club head in a first alignment position wherein said substantially flat surface of said club head rests upon a surface of a green, and for aligning said club head with respect to its direction in relation to a cup of a green in a second alignment position that is congruent with addressing a golf ball to be putted towards a cup of a green.

11. The golf putter in accordance with claim 10, wherein said means defining said reflective surface comprises a substantially semi-circular wedge disposed on the upper portion of said club head.

12. The golf putter in accordance with claim 10, wherein said means defining said reflective surface comprises a polished surface on the upper portion of said club head.

13. The golf putter in accordance with claim 10, wherein said means defining said reflective surface comprises a plated surface on the upper portion of said club head.

14. The golf putter in accordance with claim 10, wherein said means defining said reflective surface comprises a mirrored surface on the upper portion of said club head.

15. The golf putter in accordance with claim 10, wherein said means for aligning a stance of a golfer with respect to said club head in a first alignment position includes a sight line disposed upon said reflective surface.

* * * * *